US005756871A

United States Patent [19]

Wang

[11] Patent Number: 5,756,871

[45] Date of Patent: May 26, 1998

[54] TREATING METHOD FOR CONVERTING WASTES INTO RESOURCES AND ITS EQUIPMENT

[75] Inventor: Hung Paul Wang, Tainan, Taiwan

[73] Assignee: California Engineering Consultants Co., Ltd., Tainan Hsien, Taiwan

[21] Appl. No.: 445,198

[22] Filed: May 23, 1995

[51] Int. Cl.[6] ..... C07C 1/00; A62D 3/00; C01B 31/00

[52] U.S. Cl. ..... 585/241; 423/449.6; 423/499.7; 588/205; 588/228; 588/900

[58] Field of Search ..... 423/449.7, 449.8; 585/241

[56] References Cited

U.S. PATENT DOCUMENTS

| | | | |
|---|---|---|---|
| 3,808,328 | 4/1974 | Kelly | 423/449.7 |
| 4,250,158 | 2/1981 | Solbakkan | 423/449.6 |
| 4,284,616 | 8/1981 | Solbakkan | 423/449.7 |
| 4,983,278 | 1/1991 | Cha et al. | 208/407 |
| 5,041,209 | 8/1991 | Cha et al. | 208/251 |
| 5,364,996 | 11/1994 | Castagnoli et al. | 585/241 |
| 5,389,691 | 2/1995 | Cha et al. | 585/241 |
| 5,423,950 | 6/1995 | Avetisian et al. | 585/241 |
| 5,464,503 | 11/1995 | Avetisian et al. | 585/241 |
| 5,569,801 | 10/1996 | de Broqueville | 585/241 |

*Primary Examiner*—Gary P. Straub

*Attorney, Agent, or Firm*—Morton J. Rosenberg; David I. Klein; Jun Y. Lee

[57] ABSTRACT

A continuous treating method for converting waste into resources is provided that includes the steps of comminuting, liquefying, condensing hot gaseous oil, separating organic matter form inorganic matter, and washing the inorganic matter. Prior to the liquefaction step, the comminuted waste is soaked in oil in an inclined screw conveyor for wetting the comminuted waste and excluding air therefrom during subsequent steps. The liquefaction is carried out within a converter having a rotating screw for displacing the oil soaked waste therethrough during a time period approximating 30 minutes. The waste within the converter is maintained at a temperature within the approximating range of 200°–370° C.

3 Claims, 2 Drawing Sheets

TREATING METHOD FOR CONVERTING WASTES INTO RESOURCES AND ITS EQUIPMENT

This invention concerns a treating method for converting wastes into resources and its equipment, particularly able to apply to scrap petrochemical products, utilizing waste heavy oil, motor oil and lubricating oil as an oil solvent medium, coordinated operation of a plurality of inclined screw converters, through a variety of processes of continuously feeding wastes, liquefying, separating, and recycling, treating more than two kinds of wastes synchronously.

At present, solid organic wastes produced among all kinds of wastes discarded in Taiwan is estimated to be more than 30 million tons, and their latent heat value may amount to 40 thousand billion calories. Half of the solid organic wastes may be petrochemical products such as auto shredder residues, scrap tires, scrap printed electric circuit boards, scrap plastics, scrap rubber, oily dirt, sludge, etc. However, this extremely large amount of petrochemical waste includes many kinds of inorganic matter, such as iron, copper, lead, zinc, fiber, wood, glass, etc., so treating and converting it into resources is a gigantic difficulty.

Generally speaking, there are many methods for disposing or treating wastes, depending on the kind of wastes and objects, in addition to advantages and disadvantages. Although a traditional simple land filling method can collect wastes in a set location, land filling is unable to recycle the wastes properly so as to recover its heat value. Treating wastes with incineration can solve a partial problem, but very small particles of heavy metals, nitric oxide or haloids continuously produced thereby will pollute the environment over a long period of time.

SUMMARY OF THE INVENTION

A main purpose of this invention is to offer a treating method for converting wastes into resources and its equipment, making use of waste motor oil, lubricating oil, etc. as a solvent medium, dissolving organic matters in hot motor oil and separating the organic matters from inorganic matters to reduce true waste as much as possible.

A second purpose of this invention is to offer a treating method for converting wastes into resources, by which a large amount of waste motor oil (about 150 thousand tons a year in Taiwan) may be used for treating and converting wastes such as scrap tires into resources by means of liquefaction, performing treatment of more than two kinds of wastes at the same time.

A third purpose of this invention is to offer a treating method for converting wastes into resources and its equipment, wherein wastes are liquified in an inclined screw converter, converting high molecular organic matter in the wastes into recyclable oil, which is refined into fuels or directly used as a fuel.

A fourth purpose of this invention is to offer a treating method for converting wastes into resources and its equipment, wherein a liquefying process using catalysts to enhance the production rate of the valuable condensates and absorbers/adsorbers to remove heavy metals, sulfur, or halogen containing compounds from oils, is employed. The catalyst, absorbers and/or adsorber would be recovered by the screw conveyor employed. The process can reduce the difficulty of the separation and transportation steps, having considerable compatibility and flexibility for treating a wide range of wastes, in addition to being a simple treating process.

BRIEF DESCRIPTION OF THE DRAWINGS

The invention will be better understood by reference to the accompanying drawings, wherein.

DESCRIPTION OF THE PREFERRED EMBODIMENTS

Figure 1:
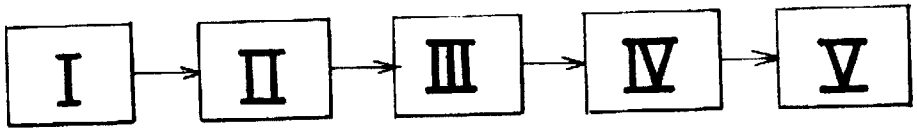
FIG. 1 is a flow chat of a treating method for converting wastes into resources and its equipment in the present invention.
Figure 2:
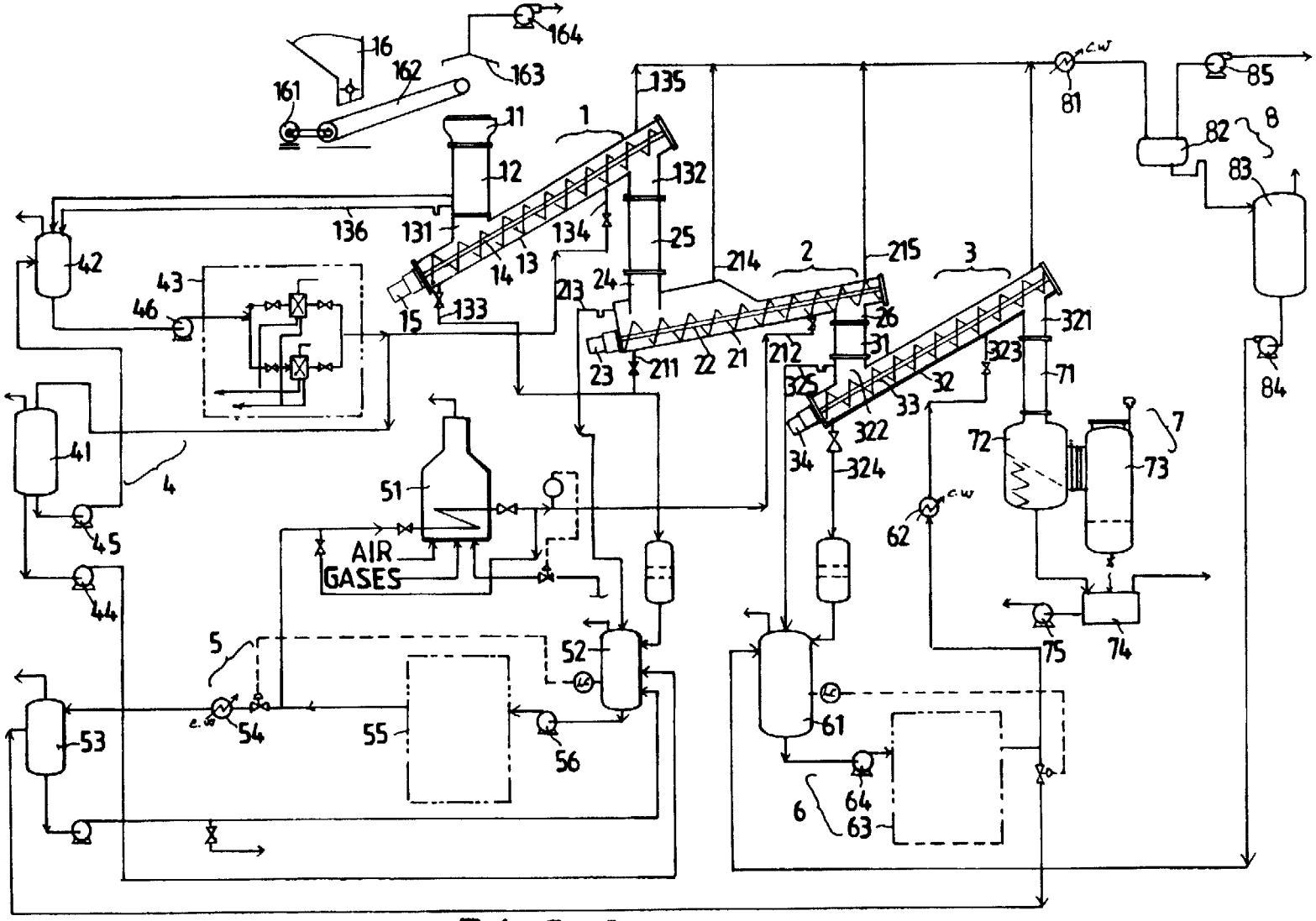
FIG. 2 is a diagram of equipment for treating and converting wastes into resources in the present invention.

A treating method for converting wastes into resources in the present invention, as shown in FIGS. 1 and 2, includes following treating processes arranged in the following order:

(I) Comminuting: Wastes are comminuted by a pulverizer into tiny bits or small pieces of proper size, for example, scrap tires are preferably comminuted into pieces 5–10 cm long.

(II) Soaking in oil: Comminuted wastes are placed in an oil sealed feed conveyor for soaking it in oil therein, wetting the surface of wastes and insulating it from air and removing air in the wastes so as to be continuously operated.

(III) Liquefying and dissolving: The oil-soaked comminuted wastes are transported into a converter, wherein organic matter is converted into oil and separated from inorganic matter in the wastes, by means of circulating oil of high temperature.

(IV) Condensing: The organic matter separated in the converter is taken out and condensed, to be stored in a storage tank.

(V) Washing: Solid residues are removed from the converter, and are washed or extracted with product condensate in a residue screw conveyor, separating leftover solid inorganic matter.

Figure 3:
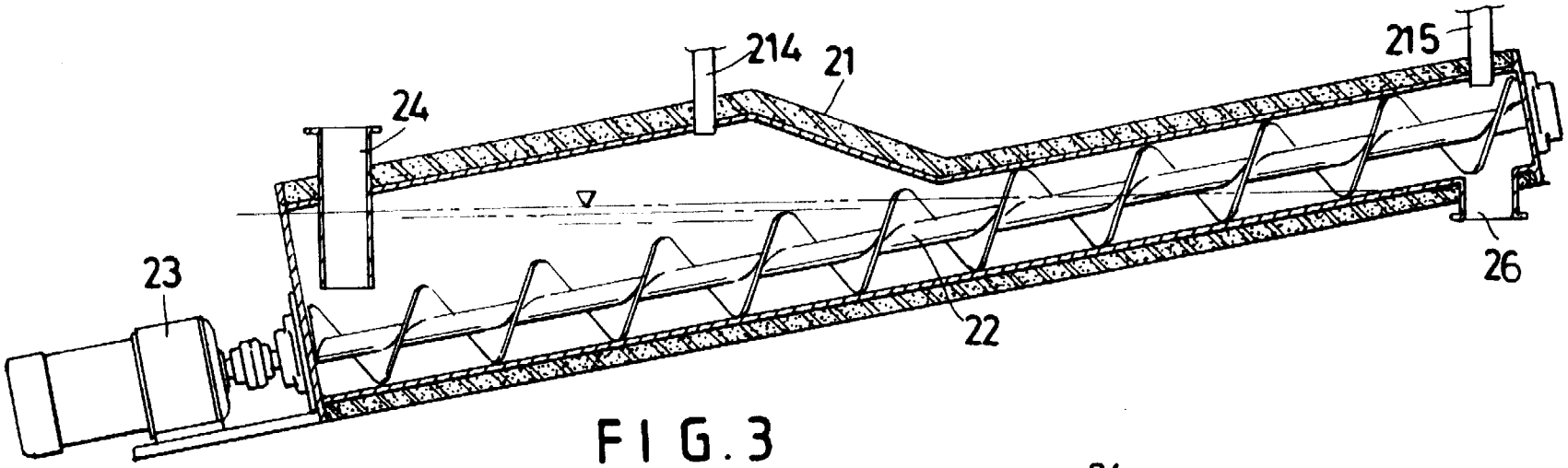
FIG. 3 is a cross-sectional view of a converter in the equipment for treating and converting wastes into resources in the present invention; and, FIG. 4 is a front cross-sectional view of the converter in the equipment for treating and converting wastes into resources in the present invention.
Figure 4:
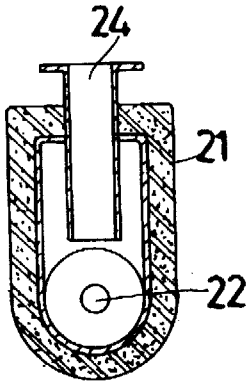

Equipment for treating and converting waste into resources in the present invention, as shown in FIGS. 2, 3 and 4, includes an oil sealed feed conveyor 1, a converter 2, an oil sealed residue conveyor 3, an oil soaking control device 4, a converter oil control device 5, a wash oil control device 6, an organic matter recycling device 7 and a gas-liquid separating device 8 combined together.

The oil sealed feed conveyor 1 shown in FIG. 2 consists of a feed funnel 11, a feed tube 12, a housing 13, a screw 14 and a motor 15. Wastes such as auto shredder residues, scrap tires, printed circuit boards, etc., are comminuted by a pulverizer 16 into tiny bits or pieces of proper size, and transported into the inclined conveyor housing 13. The feed funnel 11 is arranged with a hood 163 and a vent blower 164 connected with an activated carbon absorber. A screw 14 is fixed in the sloped housing 13, rotated by a motor 15. A feed inlet 131 is provided in a lower portion of the housing 13 and a feed outlet 132 is provided in an upper portion thereof so that wastes conveyed in the housing 13 may be properly soaked in oil when moving in the housing 13 and then carried into the converter 2. The housing 13 also has an oil outlet tube 133, an oil inlet tube 134 and a passageway tube 135. The feed inlet 131 is located just under the feed inlet tube 12 fixed under the feed funnel 11, and the feed inlet tube 12 is attached with an overflow tube 136.

The converter 2, as shown in FIGS. 3 and 4, consists of a housing 21 of a U-shaped cross-section, a screw 22 fixed in a lower portion of the housing 21 and a motor 23 rotating the screw 22. An inlet tube 24 is provided to protrude in the housing 21, connected with a converter feed tube 25 at an upper portion, with the converter feed tube 25 being connected with the outlet 132 of the oil sealed feed conveyor 1 so as to liquefy the comminuted waste solids by means of circulating oils and dissolve them in the oil solvent. The housing 21 of the converter 2 is properly sloped, having an outlet tube 26, an oil outlet tube 211 and an oil inlet tube 212, an overflow tube 213, and passageway tubes 214 and 215 on the top. Oil-soaked waste pieces are liquefied and dissolved at temperatures of 200°–370° C. for 30 minutes when moving in the converter 2.

The oil sealed residue conveyor 3 has a similar structure as the oil sealed feed conveyor 1, having a feed inlet tube 31, a housing 32, a screw 33 and a motor 34 combined together. The housing 32 has an outlet 321, an inlet 322, an oil outlet tube 323, an oil inlet tube 324 and an overflow tube 325. The oil sealed residue conveyor 3 washes and separates residue inorganic wastes after liquefying process while moving in the housing 32.

The soaking oil control device 4 consists of a heavy oil storage tank 41, a heavy oil drum 42, a passageway solid-liquid separating control set 43, and liquid pumps 44, 45 and 46. The heavy oil drum 42 is connected with the feed tube 12 to feed oil in the oil sealed feed conveyor 1 and keep the oil therein at a constant level, together with operation of the liquid pump 46 and the passageway solid-liquid separating control set 43 so that the wastes moving in the oil sealed conveyor 1 may be soaked in oil and insulated from air for continuous subsequent operations.

The converter oil control device 5 consists of a fire heater 51, a hot oil drum 52, a mixed heavy oil storage tank 53, a heavy oil cooler 54, a passageway solid-liquid separating control set 55, and liquid pumps 56, 57. The hot oil drum 52 is connected with the oil outlet tubes 133, 211, supplying partial heavy oil by means of the pumps 44 and 57, and transporting recycled hot oil in the mixed heavy oil storage tank 53 and the fire heater 51 together with operation of the passageway solid-liquid separating control set 55 and the heavy oil cooler 51 so as to supply hot oil of 200° C.–450° C. to the converter 2, wherein oil-soaked waste may be heated by high temperature for separating the organic matter from the inorganic matter.

The wash oil control device 6 consists of a wash oil drum 61, a wash oil cooler 62, a passageway solid-liquid separating control set 63, and a liquid pump 64. Oil coming from the outlet tube 323 and the overflow tube 325 enters the wash oil drum 61, cooled by coordinated operation of the wash oil cooler 62, the liquid pump 64 and the passageway solid-liquid separating control set 63, and then sent into the residue conveyor 3, wherein residue passing through the liquefying process is washed and separated.

The inorganic matter recycling device 7 has a connect tube 71 connected with the outlet tube 321 of the sealed residue conveyor 3, sending residue into the buffer storage tank 72 wherein liquid is separated from solids. Then the solid and the liquid are respectively sent into a residue storage tank 73 and a residue oil drum 74. Then oil is sent into the mixed heavy oil storage tank 53 by operation of the pump 75.

The gas and liquid separating device 8 is connected with the passageway tubes 135, 214 and 215, consisting of a condensate cooler 81, a condensate drum 82, a condensate storage tank 83, and a liquid pump 84 and a noncondensable blower 85. Gaseous oil produced after liquefying of the organic matter in hot oil medium is condensed by the condensate cooler 81 to become condensate to enter the condensate drum 82 and then the condensate storage tank 83, from which condensate is sent into the wash oil drum 61 of the wash oil control device 6 by operation of the liquid pump 84. Besides, volatile gas is blown to some other places for other treatments by a noncondensable blower 85.

As can be understood from the above description, this invention has the following advantages:

1. It can treat more than two kinds of wastes at the same time, using spent motor oil or lubricating oil as a solvent medium, for liquefying wastes, and treating and converting solid waste having a high heat latent energy into a resource.
2. It uses reaction temperatures below 370° C., far less than that used in other conventional heat treating methods, producing comparatively a small volume of gas and reducing the scale of equipment and cost needed for treating the gas, and producing mainly oils that are possible to refine or to use directly for a fuel.
3. It can dispose of auto shredder residues, scrap tires, scrap electric wires and cables, scrap plastics, scrap rubber, scrap printed/electric circuit boards, hardware organic residue, sludge, oily dirt, oil fouled soil, refuse derived fuel (RDF), widely compatible and suitable for many kinds of organic wastes and converting them into resources.
4. It receives feed of wastes and treats them orderly and continuously, with a reaction time that is able to be adjusted in case of need, and solvent oil for liquefying can be circulatingly and continuously used, and in addition, having a characteristic that all products are able to be recycled, to a resultant high economic effectiveness.
5. Catalysts such as spherical metal oxides, or absorbers such as spherical molecular sieves or metal oxides can be added for enhancing the condensate production rate and separating heavy metals, sulfur, chlorine, or toxic inorganic matters.

While the preferred embodiments of the invention have been described above, it will be recognized and understood that various modifications may be made therein and the appended claims are intended to cover all such modifications which may fall within the spirit and scope of the invention.

What is claimed is:

1. A continuous treating method for converting organic waste into resources, comprising the steps of:

a. comminuting waste into pieces approximating 5–10 cm long;

b. receiving said comminuted waste in an inclined oil sealed screw conveyor having an upper section and a lower section, and soaking said comminuted waste in a volume of oil as said comminuted waste is transported therethrough for providing a wetting of said comminuted waste and a coating thereon to exclude air from contacting said comminuted waste during subsequent steps said oil sealed screw conveyor having an oil inlet port formed through a wall of said upper section and an oil outlet port formed through a wall of said lower section;

c. receiving said oil-soaked waste from said inclined oil sealed screw conveyor in an inclined converter having an upper section and a lower section, for separating organic matter from inorganic matter and converting at least a portion of said organic matter into an oil in a continuous liquefaction process, said liquefaction process being a non-oxidation process at a temperature within the approximating range of 200°–370° C. and said inclined converter having a rotating screw for displacing said oil-soaked waste therethrough during a time period approximating 30 minutes, said inclined converter having an oil inlet port formed through a wall of said upper section and an oil outlet port formed through a wall of said lower section;

(d.) combining oil from said outlet ports of said inclined oil screw conveyor and said inclined converter to form a combined oil stream;

(e.) heating said combined oil stream to form a heated oil stream;

(f.) introducing said combined heated oil stream only to said inclined converter upper section oil inlet port;

(g.) condensing gaseous products of said organic matter separated in said liquefaction process and stored in a storage tank;

(h.) receiving said inorganic matter and undissolved organic matter from said inclined converter in an inclined oil sealed residue conveyor and washing said inorganic matter and undissolved organic matter during movement through said inclined oil sealed residue conveyor for extracting any remaining oil therefrom; and, (i.) recovering from said treating method, (1) a portion of said oil produced in step (c), (2) a portion of a condensate produced in step (g), and, (3) at least a portion of said inorganic matter produced in step (h).

2. The continuous treating method as recited in claim 1 wherein said oil in step (b) is oil selected form the group consisting of waste oil, motor oil and lubricating oil.

3. The continuous treating method as recited in claim 1 wherein said organic waste is selected form the group consisting of scrap tires, scrap plastics, and scrap rubber.

* * * * *